US007037123B2

(12) United States Patent
Nakamura et al.

(10) Patent No.: US 7,037,123 B2
(45) Date of Patent: May 2, 2006

(54) CARD CONNECTOR HAVING A STOPPER TO BE FIXED TO A MOUNTING OBJECT AND ADAPTED TO COME IN CONTACT WITH A CARD INSERTED INTO THE CARD CONNECTOR

(75) Inventors: Keisuke Nakamura, Tokyo (JP); Akira Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/037,424

(22) Filed: Jan. 18, 2005

(65) Prior Publication Data

US 2005/0159033 A1 Jul. 21, 2005

(30) Foreign Application Priority Data

Jan. 19, 2004 (JP) ..... 2004-011107

(51) Int. Cl.
*H01R 13/62* (2006.01)

(52) U.S. Cl. ..... 439/152; 439/325; 439/630; 439/92

(58) Field of Classification Search ..... 439/79–83, 439/381, 630, 607, 67, 541.5, 92, 159–160, 439/357–359, 325–328, 631–637
See application file for complete search history.

(56) References Cited

U.S. PATENT DOCUMENTS

| | | | | |
|---|---|---|---|---|
| 5,997,332 | A * | 12/1999 | Choy | 439/328 |
| 6,045,366 | A * | 4/2000 | Motomu | 439/64 |
| 6,116,950 | A * | 9/2000 | Koseki | 439/541.5 |
| 6,162,069 | A * | 12/2000 | Choy | 439/92 |
| 6,227,879 | B1 * | 5/2001 | Dong | 439/92 |
| 6,276,951 | B1 * | 8/2001 | Chen et al. | 439/327 |
| 6,840,807 | B1 * | 1/2005 | Ooya et al. | 439/630 |
| 6,843,663 | B1 * | 1/2005 | Lee | 439/92 |

* cited by examiner

*Primary Examiner*—Gary F. Paumer
*Assistant Examiner*—Edwin A. Leon
(74) *Attorney, Agent, or Firm*—Frishauf, Holtz, Goodman & Chick, P.C.

(57) ABSTRACT

In a card connector to be fixed to a mounting object and used for connecting a card, a stopper is coupled to an insulator holding a conductive contact. The stopper has a fixing portion to be fixed to the mounting object. Furthermore, the stopper has a butting portion to be engaged with the card in a predetermined direction when the card is inserted in the predetermined direction into a receiving portion defined by a cover coupled to the insulator.

13 Claims, 8 Drawing Sheets

CARD CONNECTOR HAVING A STOPPER TO BE FIXED TO A MOUNTING OBJECT AND ADAPTED TO COME IN CONTACT WITH A CARD INSERTED INTO THE CARD CONNECTOR

This application claims priority to prior Japanese Patent Application JP 2004-11107, the disclosure of which is incorporated herein by reference.

BACKGROUND OF THE INVENTION

This invention relates to a card connector for use in connecting a card.

In various types of apparatus and equipment such as a notebook-type personal computer, a PDA (personal digital assistant), and a digital camera, a card may be used for the purpose of function enhancement. In order to enable the card to be connected, the apparatus is provided with a card connector.

An existing card connector comprises an insulator, a contact held by the insulator, a cover, and an ejector slidably held by the cover. The ejector has a spring and continuously urges the card in a card ejecting direction.

Typically, the card connector is fixed to a mounting object, such as a printed board, to which the card connector is to be mounted. In this case, a soldering portion of the contact is soldered to the printed board.

When the card is inserted into the card connector, a forward end of the card is brought into contact with the insulator. Therefore, a load applied to the card is received by the contact. In the existing card connector, the soldering portion of the contact may be damaged if the load applied to the card is large.

SUMMARY OF THE INVENTION

It is therefore an object of this invention to provide a card connector which is suppressed in possibility of damage upon a fixing structure with respect to a mounting object even if a load applied to a card is large.

Other objects of the present invention will become clear as the description proceeds.

According to an aspect of the present invention, there is provided a card connector to be fixed to a mounting object and used for connecting a card, the card connector comprising a contact being conductive, an insulator holding the contact, a cover coupled to the insulator and defining a receiving portion for receiving the card in a predetermined direction, and a stopper coupled to the insulator and having a fixing portion to be fixed to the mounting object, the stopper having a butting portion to be engaged with the card in the predetermined direction when the card is inserted into the receiving portion.

DESCRIPTION OF THE PREFERRED EMBODIMENTS

At first referring to FIGS. 1 to 6, description will be made of a card connector according to a first embodiment of this invention.

Figure 1:
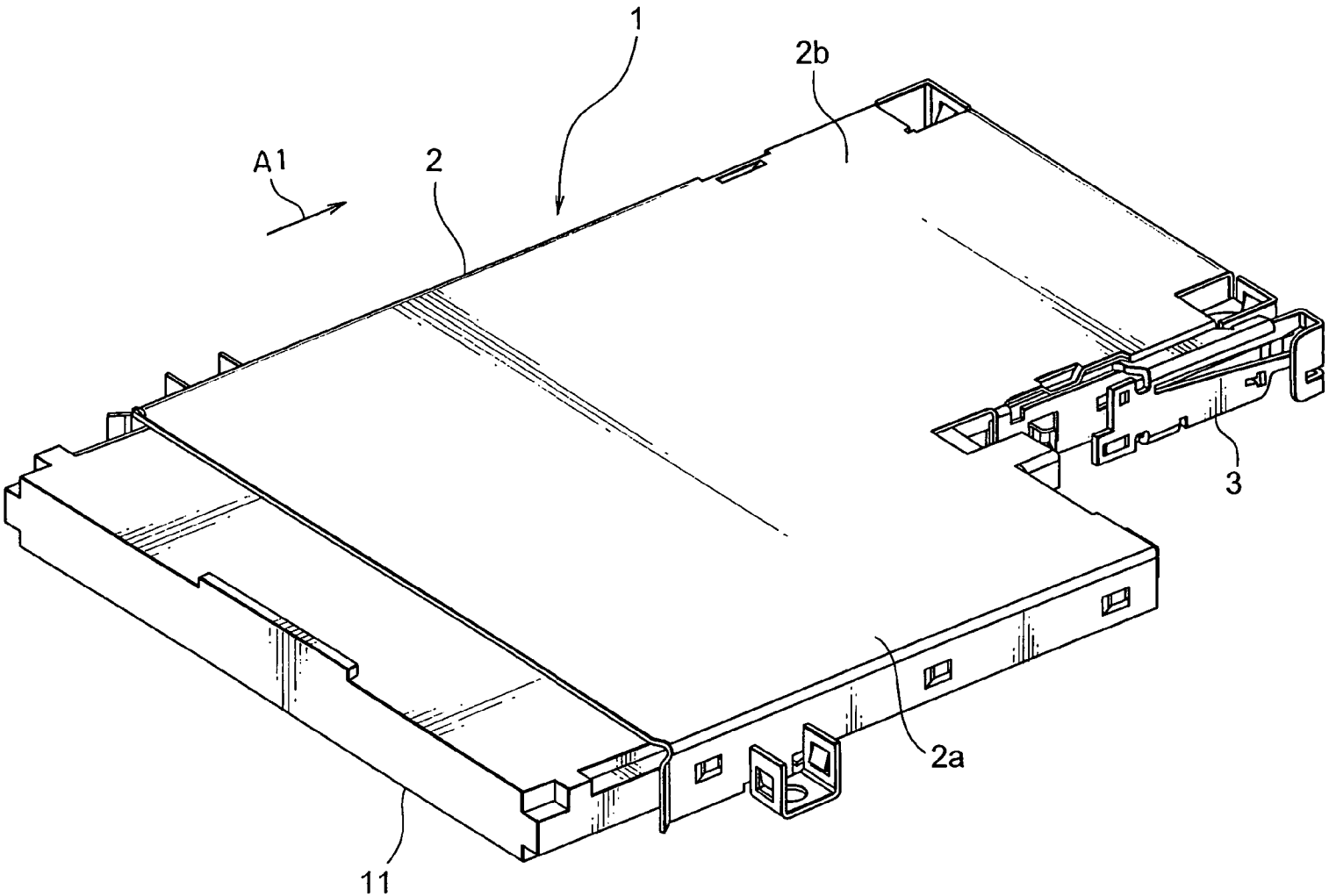
FIG. 1 is a perspective view of a card connector according to a first embodiment of this invention when a card is inserted.

Referring to FIG. 1, a card 11 is inserted into the card connector depicted at 1 in the figure. The card connector 1 includes a cover 2 defining a card receiving portion. The cover 2 has a wide portion 2*a* and a narrow portion 2*b*. On a lateral side of the narrow portion 2*b* of the cover 2, an ejector 3 for ejecting the card 11 from the card connector 1 is arranged. The card 11 is analogous in shape to the cover 2.

Figure 2:
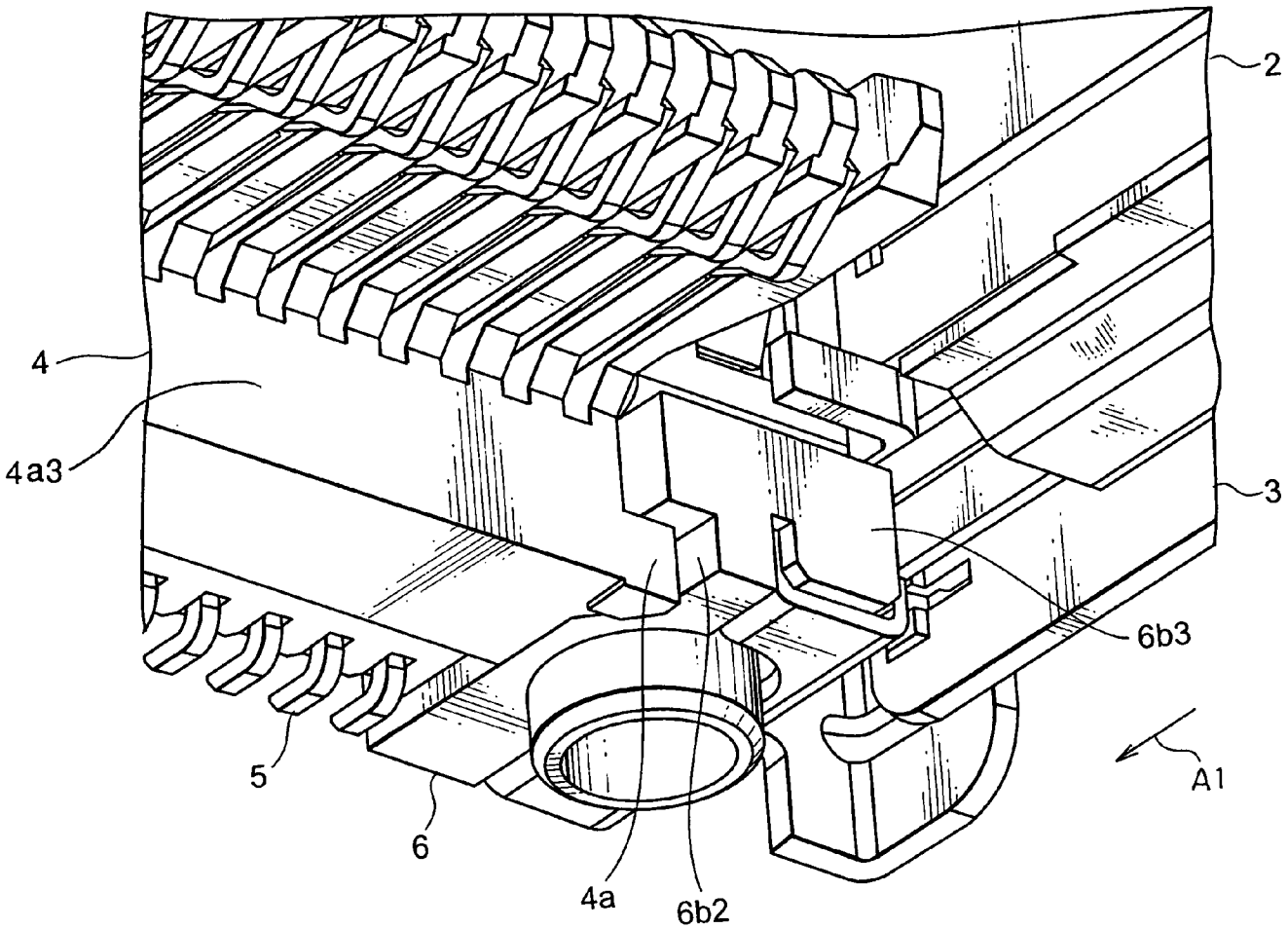
FIG. 2 is a bottom perspective view of a characteristic part of the card connector in FIG. 1.
Figure 4:
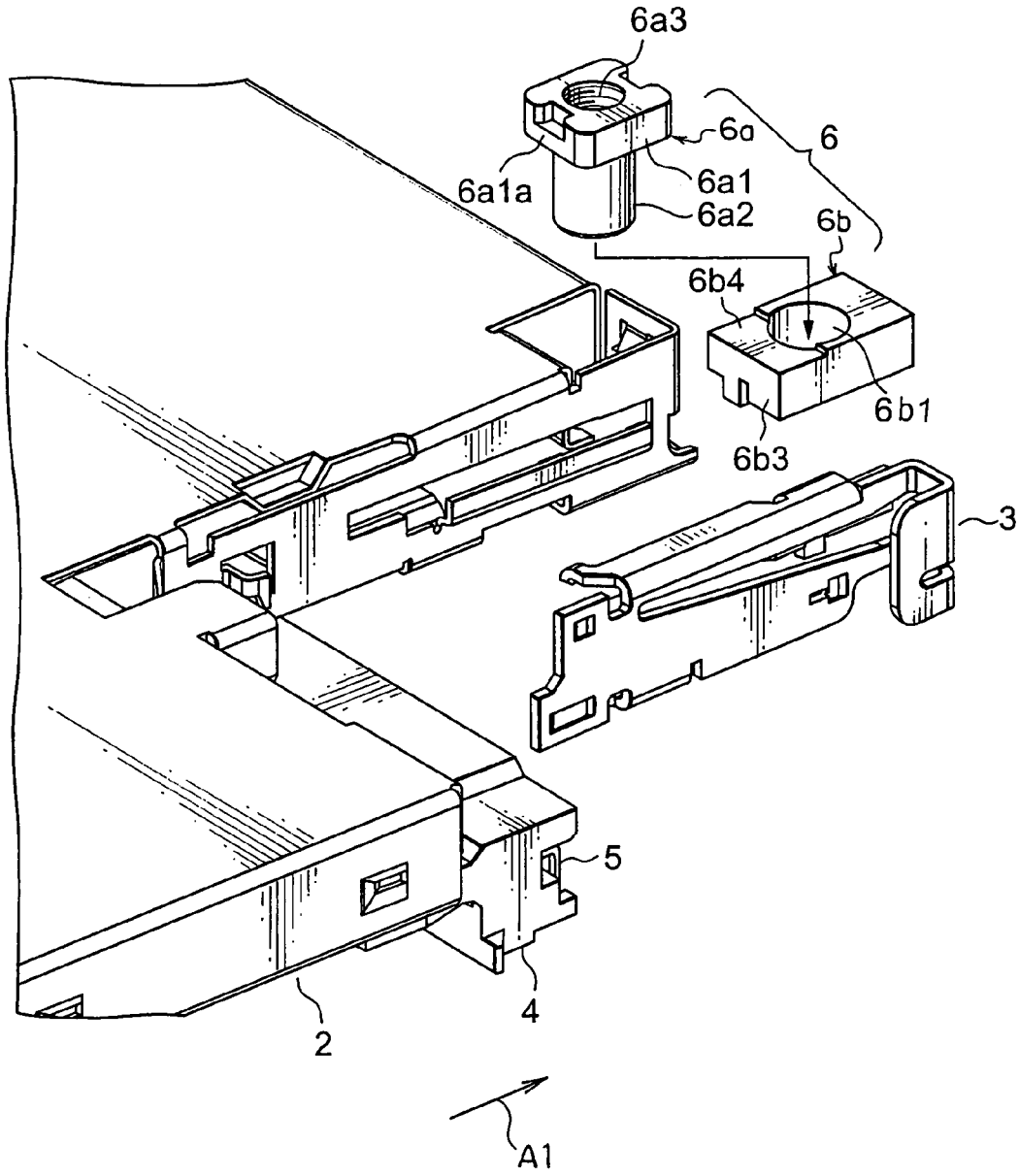
FIG. 4 is an exploded perspective view of the card connector in FIG. 1.

Referring to FIG. 2 together with FIG. 1, the card connector 1 has an insulator 4 holding a number of contacts 5 arranged in a single row at a predetermined pitch. A pair of stoppers 6 are arranged around opposite corners at an end of the narrow portion 2*b* of the cover 2. As shown in FIG. 4, each stopper 6 includes an inner stopper 6*a* and an outer stopper 6*b* coupled to the inner stopper 6*a*. The inner stopper 6*a* comprises a generally rectangular block 6*a*1 and a cylinder 6*a*2 fixed to the block 6*a*1. The outer stopper 6*b* is shaped into a generally rectangular block with a circular hole 6*b*1 to receive the cylinder 6*a*2 inserted therethrough. The outer stopper 6*b* has a recessed portion (engaging portion) 6*b*2 and a butting portion (butting surface) 6*b*3 to be engaged with a forward end of the card 11 in a predetermined direction A1 when the card 11 is inserted into the card connector 1 in the predetermined direction A1.

The inner stopper 6*a* is provided with a threaded hole 6*a*3. By screwing a screw through the threaded hole 6*a*3 into a printed board (not shown) or the like as a mounting object, the card connector 1 is fixed to the printed board or the like. The cylinder 6*a*2 is inserted into a hole formed on the printed board or the like to position the stopper 6 with respect to the printed board or the like.

The insulator 4 has protruding portions (engaged portions) 4*a* formed at opposite corners thereof. The protruding portions 4*a* are engaged with the recessed portions 6*b*2 of the outer stoppers 6*b*, respectively. Thus, the insulator 4 is fixed to the printed board through the stoppers 6.

Figure 3:
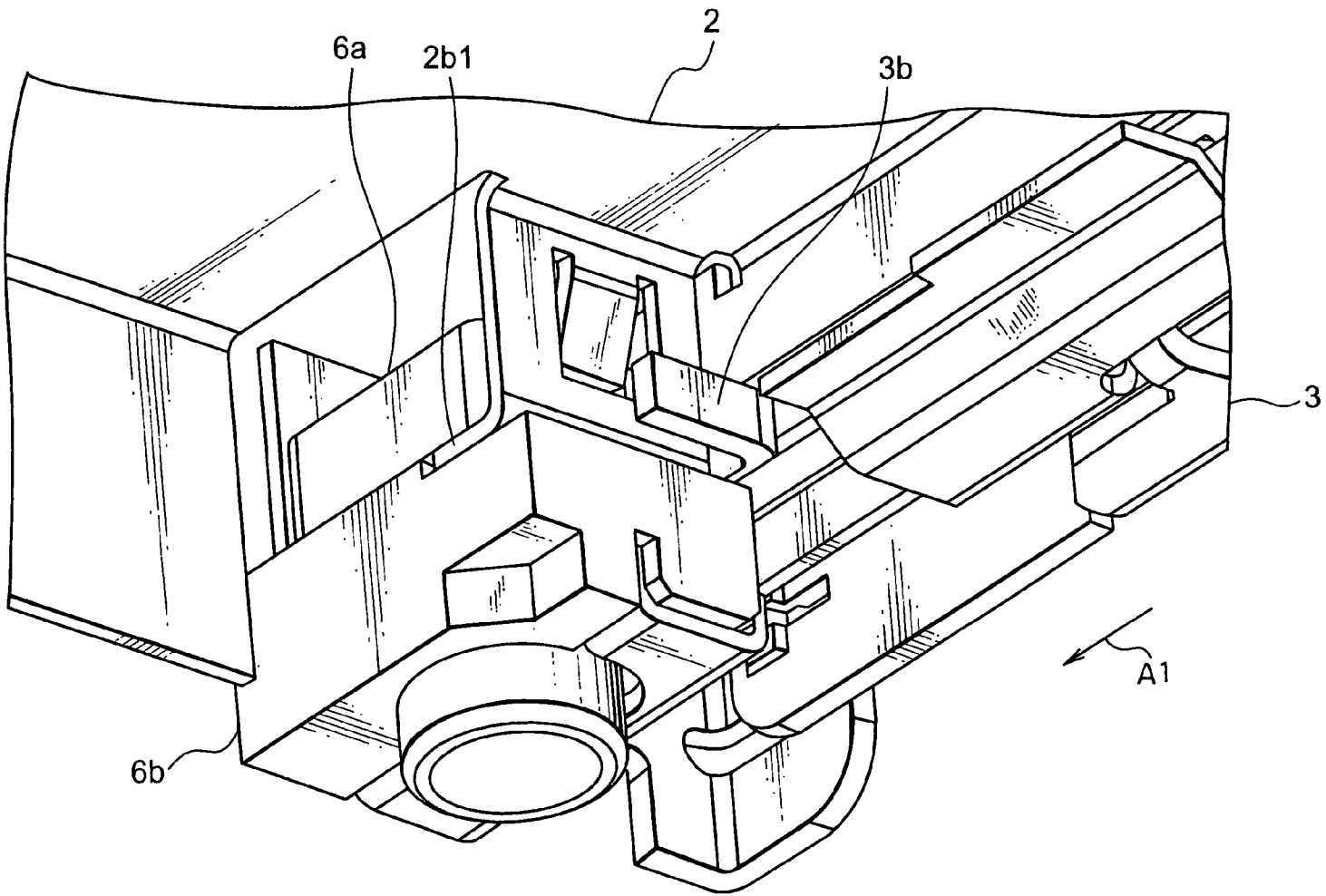
FIG. 3 is a bottom perspective view of the card connector in FIG. 1, showing a fixing structure between a stopper and a cover.
Figure 5:
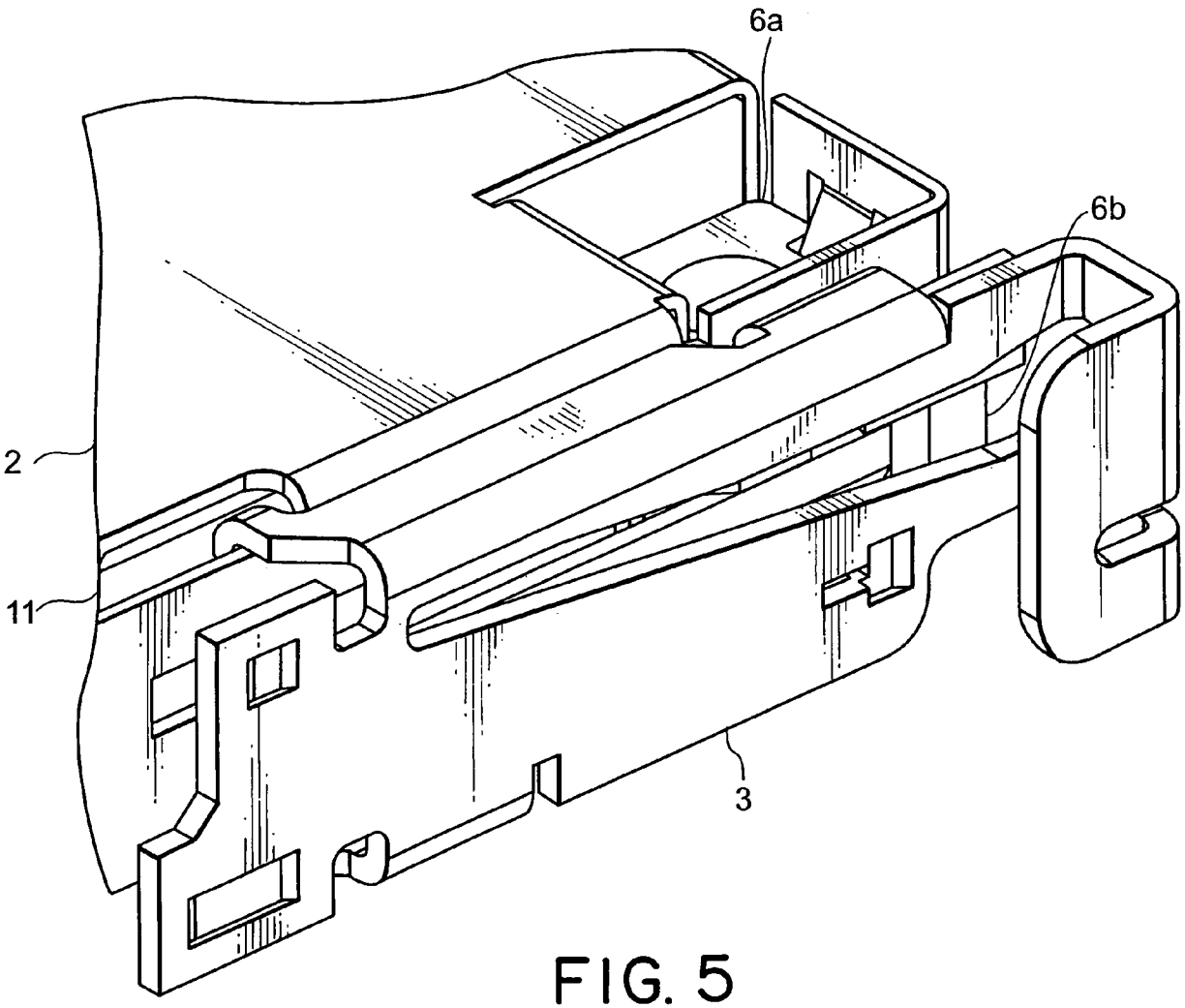
FIG. 5 is a perspective view of an ejector attached to the cover of the card connector in FIG. 1.

Referring to FIGS. 3 through 5, each of the outer stoppers 6*b* has a low-level portion 6*b*4 formed on its upper surface. Between the low-level portion 6*b*4 and the generally rectangular block 6*a*1 of the inner stopper 6*a*, a bent portion 2*b*1 of the narrow portion 2*b* of the cover 2 is clamped. With this structure, the cover 2 is prevented from undesirably floating or lifting up.

Description will be made of insertion and ejection of the card 11 into and from the card connector 1. The ejector 3 urges the card 11 by a coil spring (not shown) in a direction of ejecting the card 11 from the card connector 1.

Figure 6:
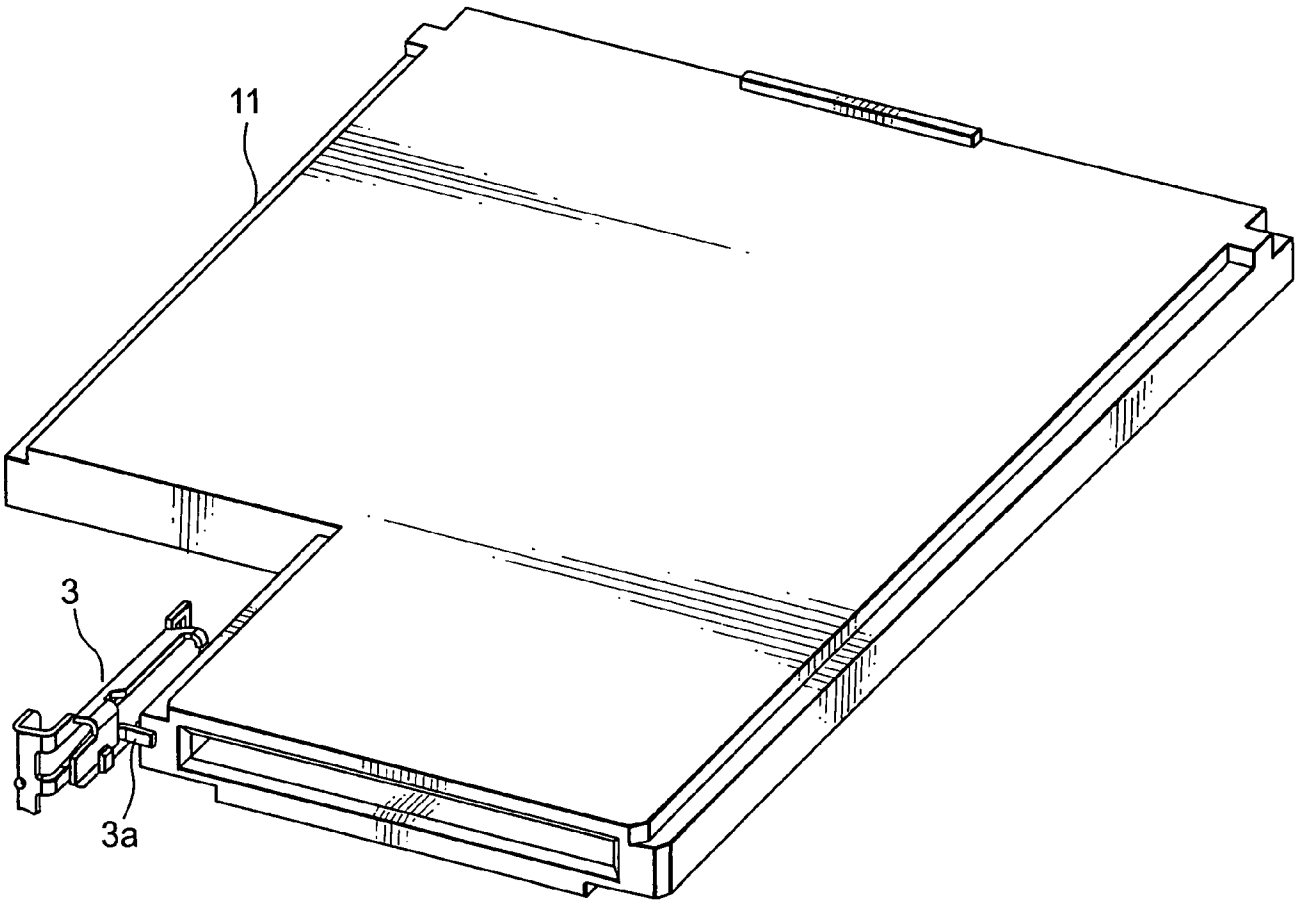
FIG. 6 is a perspective view of the card connector in FIG. 1 in a state where a card contacting portion of the ejector is brought into contact with a forward end of the card.

When the card 11 is inserted into the card connector 1, the forward end of the card 11 presses a card contacting portion 3*a* of the ejector 3 (see FIG. 6). The forward end of the card 11 is brought into contact with the butting portions 6*b*3 of the outer stoppers 6*b*. A protruding portion 3*b* of the ejector 3 is brought into contact with a contacting portion 6*a*1*a* of one of the inner stoppers 6*a*. Since a step is formed between the butting portion 6*b*3 and a bottom portion 4*a*3 of the insulator 4 (see FIG. 2), the forward end of the card 11 does not come into contact with the insulator 4. In this state, contact points of the card 11 are connected to the contacts 5 of the card connector 1, respectively. The ejector 3 is locked by a lock mechanism (not shown).

In order to eject the card 11 from the card connector 1, the lock mechanism is unlocked. Then, the card contacting portion 3*a* of the ejector 3 presses the forward end of the card 11 by a reactive force of the coil spring. As a consequence, the card 11 is ejected from the card connector 1.

With the card connector 1 mentioned above, the card 11 is brought into contact with the butting portions 6*b*3 of the stoppers 6 fixed to the mounting object. Therefore, even if the card 11 is subjected to a large load, the load is received by the stoppers 6 without adversely affecting soldering portions of the contacts 5. Further, the number of components is reduced so that the size of the card connector 1 can be reduced and the cost is saved.

Figure 7:
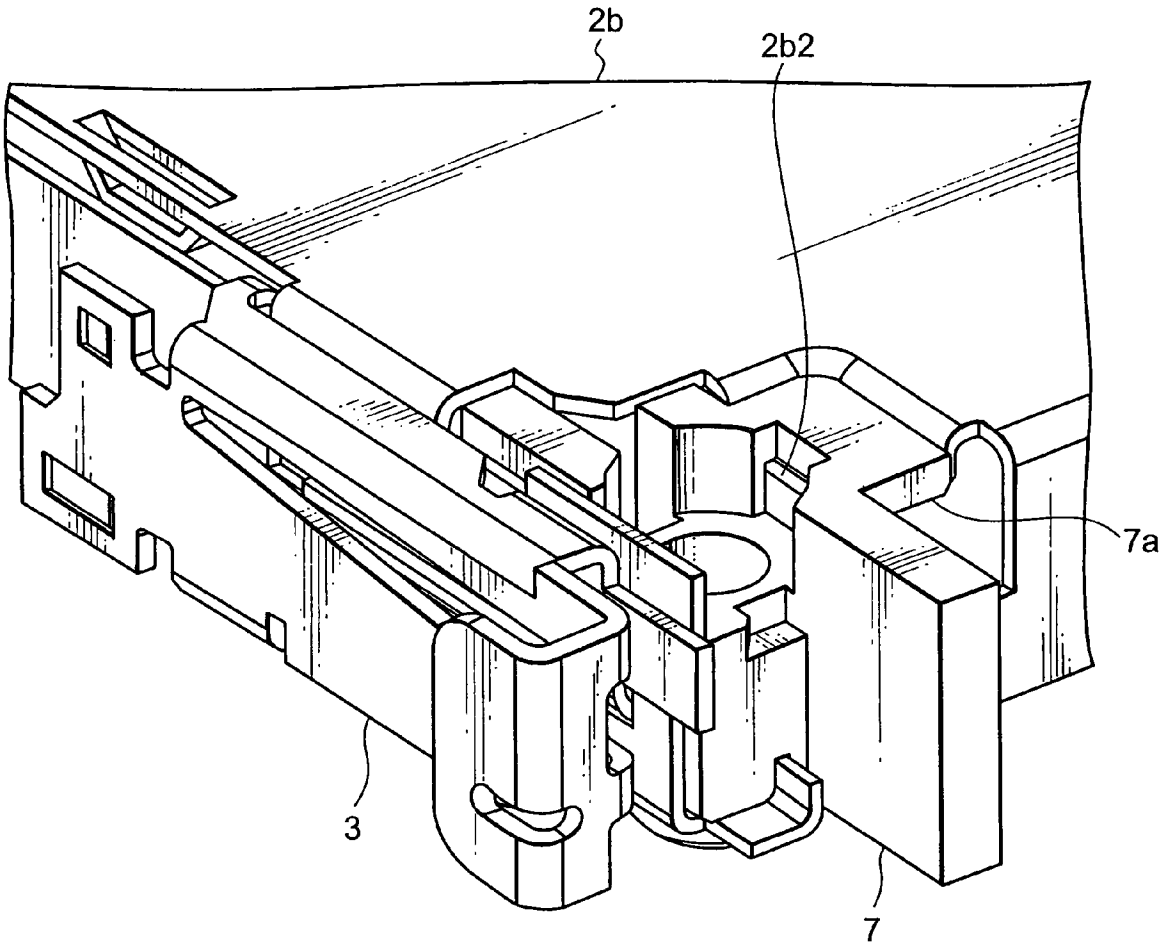
FIG. 7 is a top perspective view of a characteristic part of a card connector according to a second embodiment of this invention.
Figure 8:
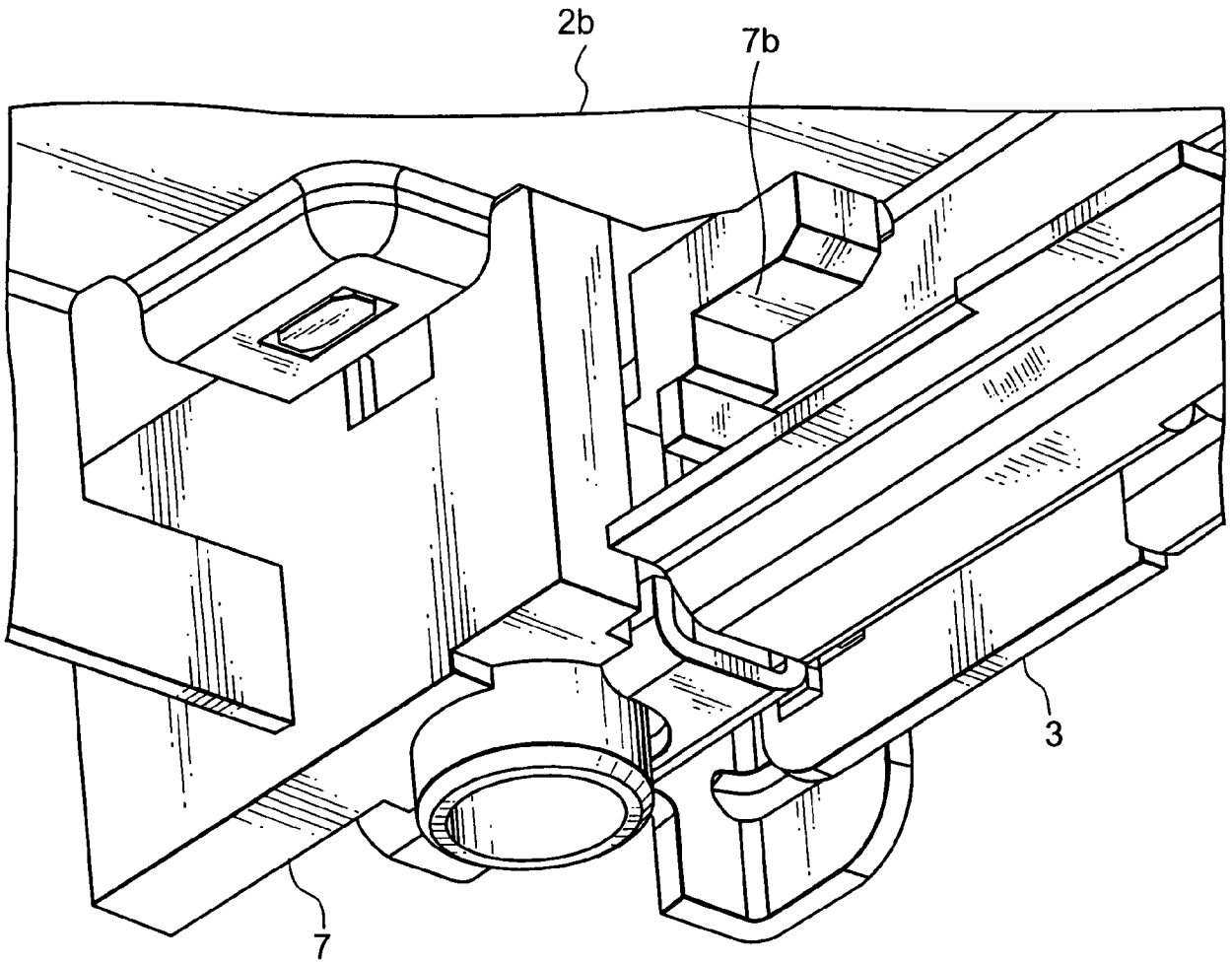
FIG. 8 is a bottom perspective view of the characteristic part of the card connector in FIG. 7.

Referring to FIGS. 7 and 8, description will be made of a card connector according to a second embodiment of this invention. Similar parts are designated by like reference numerals and description thereof will be omitted.

In the card connector illustrated in FIGS. 1 through 6, each of the stoppers 6 comprises two components, i.e., the inner stopper 6*a* and the outer stopper 6*b*. On the other hand, in the card connector illustrated in FIGS. 7 and 8, a stopper 7 as a whole comprises a single element. The stopper 7 has a flange 7*a* formed at an upper part on one side thereof. A tongue-like portion 2*b*2 of the narrow portion 2*b* of the cover 2 is engaged with a lower side of the flange 7*a* to prevent the cover 2 from undesirably floating or lifting up.

The stopper 7 is provided with an overhanging portion 7*b* formed at an upper part on the other side. If the card 11 is forced upward (in a thickness direction of the card 11), an upper surface of the card 11 is brought into contact with the overhanging portion 7*b* to prevent the card 11 from moving upward. Also, the tongue-shaped portion 2*b*2 exhibits a function similar to that of the overhanging portion 7*b*.

In the foregoing description, both of the card and the ejector are brought into contact with the stopper. Alternatively, either one of the card and the ejector may be brought into contact with the stopper.

While this invention has thus far been described in connection with the preferred embodiments thereof, it will be readily possible for those skilled in the art to put this invention into practice in various other manners without departing from the scope set forth in the appended claims.

What is claimed is:

1. A card connector to be fixed to a mounting object and adapted to be connected to a card, the card connector comprising:

a conductive contact;

an insulator holding the contact;

a cover which is coupled to the insulator and defines a receiving portion for receiving the card, which is adapted to be inserted into the receiving portion in a predetermined direction; and a discrete stopper which is coupled to the insulator and comprises a fixing portion to be fixed directly to the mounting object, and a butting portion to be engaged with the card to stop movement of the card along the predetermined direction when the card is inserted into the receiving portion;

wherein the insulator is set back from the butting portion of the stopper along the predetermined direction such that a step is formed between the butting portion and the insulator, and such that when the card is inserted into the receiving portion to be in contact with the butting portion, the card does not contact the insulator; and wherein the insulator comprises an engaged portion, and the stopper comprises an engaging portion that engages the engaged portion such that the insulator is fixed to the mounting object via the stopper.

2. The card connector according to claim 1, wherein the stopper comprises an overhanging portion for preventing the card from moving in a thickness direction of the card.

3. The card connector according to claim 1, wherein the cover comprises a tongue-like portion engaged with the stopper to prevent the card from moving in a thickness direction of the card.

4. The card connector according to claim 1, further comprising an ejector which is movable with the card, and which is brought into contact with the butting portion of the stopper when the card is inserted into the receiving portion.

5. The card connector according to claim 1, wherein the mounting object comprises a hole, and the stopper comprises a cylinder to be inserted into the hole of the mounting object to position the stopper.

6. The card connector according to claim 5, wherein the stopper comprises:

an inner stopper including the cylinder and a block fixed to one end of the cylinder; and an outer stopper which faces the block of the inner stopper and which comprises a hole for receiving the cylinder, which is inserted through the hole.

7. The card connector according to claim 6, wherein the cylinder is inserted into the hole of the mounting object through the hole of the outer stopper.

8. The card connector according to claim 5, wherein the stopper is formed by a single element.

9. The card connector according to claim 8, wherein the stopper comprises a flange engaged with the cover.

10. The card connector according to claim 9, wherein the cover comprises a tongue-shaped portion engaged with the flange.

11. A card connector to be fixed to a mounting object and adapted to be connected to a card, the card connector comprising:

a conductive contact;

an insulator holding the contact;

a cover which is coupled to the insulator and defines a receiving portion for receiving the card, which is adapted to be inserted into the receiving portion in a predetermined direction; and a stopper, which is formed by a single element, which is coupled to the insulator, and which comprises a fixing portion to be fixed to the mounting object, and a butting portion to be engaged with the card along the predetermined direction when the card is inserted into the receiving portion;

wherein the mounting object comprises a hole, and the stopper comprises a cylinder to be inserted into the hole of the mounting object to position the stopper.

12. The card connector according to claim 11, wherein the stopper comprises a flange engaged with the cover.

13. The card connector according to claim 12, wherein the cover comprises a tongue-shaped portion engaged with the flange.

* * * * *